United States Patent [19]

Gress

[11] Patent Number: 4,508,271

[45] Date of Patent: Apr. 2, 1985

[54] AIRBRUSH ASSEMBLY

[76] Inventor: Ronald A. Gress, 6921 Clinton, Hollywood, Calif. 90036

[21] Appl. No.: 374,088

[22] Filed: May 3, 1982

[51] Int. Cl.[3] ..... A62C 31/00; B05B 12/14

[52] U.S. Cl. ..... 239/305; 239/307

[58] Field of Search ..... 239/302, 303, 304, 307, 239/310, 311, 413, 414; 222/144.5; 137/625.41

[56] References Cited

U.S. PATENT DOCUMENTS

| | | | |
|---|---|---|---|
| 1,090,863 | 3/1914 | Kelley | 239/305 |
| 3,119,527 | 1/1964 | Dyer | 222/144.5 |
| 3,916,951 | 11/1975 | Schmitt | 137/625.41 |
| 4,178,963 | 12/1979 | Riefler | 222/144.5 |
| 4,271,984 | 6/1981 | Ducros et al. | 222/144.5 |

*Primary Examiner*—John J. Love
*Assistant Examiner*—Jon M. Rastello
*Attorney, Agent, or Firm*—Romney Golant Martin & Ashen

[57] ABSTRACT

An airbrush assembly comprising an airbrush adapted to receive a gas under pressure and a fluid, such as paint, and to eject the fluid in an atomized form entrained in the gas, supply means for supplying a plurality of fluids having differing characteristics, such as color, and selection means coupled to the supply means and the airbrush for receiving the plurality of fluids and for selecting one or more of the plurality of fluids to supply to the airbrush. Means are also provided for mixing the selected fluids prior to reaching the airbrush and for selecting complementary colors.

7 Claims, 12 Drawing Figures

FIG. 1
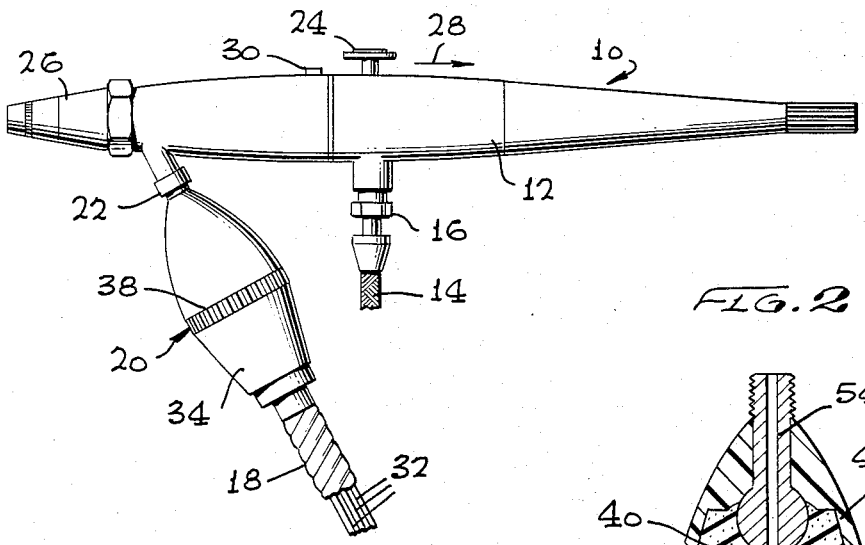
FIG. 2
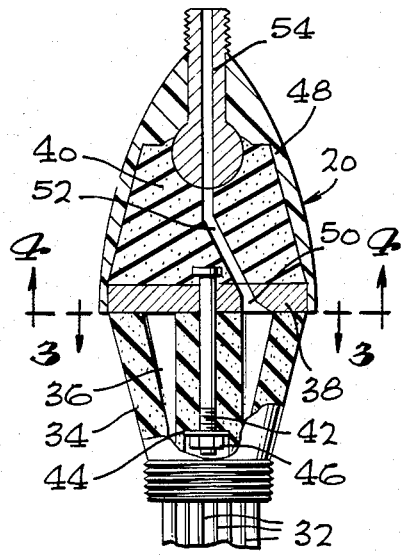
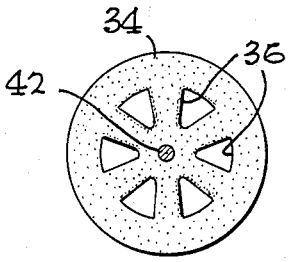
FIG. 3
FIG. 4
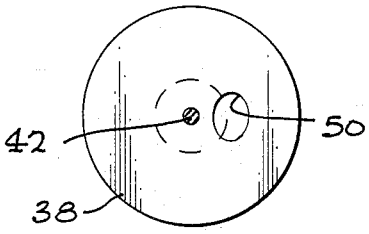
FIG. 5
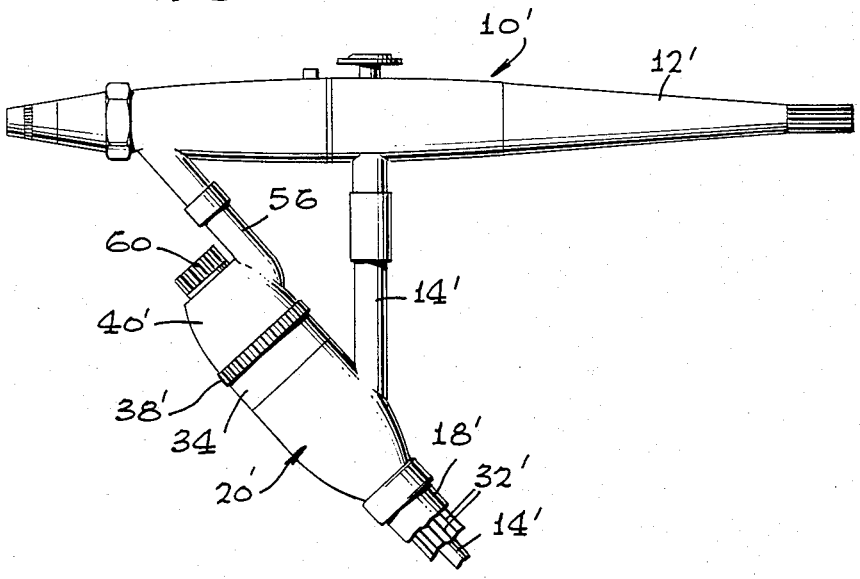

AIRBRUSH ASSEMBLY

TECHNICAL FIELD

The invention relates to the field of airbrushes and, in particular, to an airbrush assembly which is capable of applying a multiplicity of colors or blends of colors.

BACKGROUND ART

Airbrushes are commonly used by commercial artists and photographers for applying color and shading to drawings, prints and photographs, to accentuate highlights and to supply backgrounds to films. In the airbrush, which is often shaped like a pencil, compressed air from a nozzle is utilized to atomize paint in a controlled pattern. The nozzle operates by impinging high-velocity turbulent air on or across the surface of such paint causing it to collapse to droplets with a wide variety of sizes which are then directed onto a surface.

In a typical airbrush assembly, a bottle containing the color to be applied is connected to the airbrush. The bottle has an outlet hole through which the paint is aspirated by compressed air and an inlet hole into which air is drawn so that a vacuum in the bottle does not occur. A supply of compressed air is coupled to the airbrush and the compressed air passes through a small orifice adjacent the outlet hole. The flow of air draws the color material out of the bottle, due to the low pressure region across the outlet hole caused by the venturi effect, atomizes it into droplets and mixes it with the compressed air, and applies it to the surface being colored.

The prior art airbrush assemblies have, however, numerous drawbacks. For each different color or blend of color a different bottle had to be attached to the airbrush. This was time consuming and tedious and interrupted the flow of working with the airbrush. In addition, for adding black or white or a solvent, the airbrush had to be cleaned out and the white, black or solvent added as with any other color. Moreover, the outlet hole from the bottle had a tendency to become plugged during operation of the airbrush due to the viscosity of the color material. Finally, the air inlet hole would also become plugged with color pigment due to the color material being moved across the air inlet hole from the motion of the bottle during airbrushing.

Accordingly, it is a general object of the present invention to provide an improved airbrush assembly.

It is another object of the present invention to provide an airbrush assembly which utilizes a multiplicity of color materials without work interruption to change containers.

It is a further object of the present invention to provide an airbrush assembly in which the plugging of paint and air holes is minimized.

It is still another object of the present invention to provide an airbrush assembly which does not have to be cleaned out to add black, white or solvent materials.

DISCLOSURE OF INVENTION

An airbrush assembly for use in commercial, recreational and fine artistry and photography is provided. The airbrush assembly comprises an airbrush adapted to receive a gas under pressure and a fluid, such as paint, and to eject the fluid in an atomized form entrained in the gas, a plurality of hoses for supplying fluids having differing characteristics, such as color, and a selection means coupled to the hoses and the airbrush for receiving the fluids and for selecting one or more of the fluids to supply to the airbrush. Apparatus is also provided for mixing the selected fluids prior to reaching the airbrush and for selecting complementary colors.

The novel features which are believed to be characteristic of the invention, both as to its organization and its method of operation, together with further objects and advantages thereof, will be better understood from the following description in connection with the accompanying drawings in which several embodiments of the invention are illustrated by way of example. It is to be expressly understood, however, that the drawings are for purposes of illustration and description only and are not intended as a definition of the limits of the invention.

BRIEF DESCRIPTION OF THE DRAWINGS

FIG. 1 is a side elevation view of a first embodiment of the present invention.

FIG. 2 is a cross-sectional view of the selection means of the embodiment of FIG. 1.

FIG. 3 is an end view of the selection means of the embodiment of FIG. 1. taken along line 3—3 of FIG. 2.

FIG. 4 is an end view of the selection means of the embodiment of FIG. 1. taken along line 4—4 of FIG. 2.

FIG. 5 is a side elevation view of a second embodiment of the present invention.

BEST MODE FOR CARRYING OUT THE INVENTION

Figure 6:
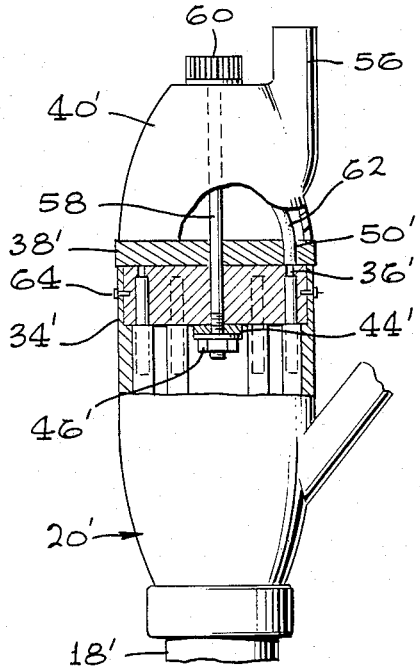
FIG. 6 is a side elevation, partially cross-sectional view of the selection means of the embodiment of FIG. 5.

Referring now to FIG. 1, a side elevation view of a first embodiment of the present invention is illustrated. The airbrush assembly 10 comprises a standard commercial airbrush 12 having a source of pressurized air (not shown) coupled thereto by pneumatic hose 14 and fitting 16 and a fluid supply (not shown), such as paint, coupled thereto by hose bundle 18, selection means 20 and connector fitting 22. The airbrush 12 has a control knob 24 which when pushed down allows air to enter the airbrush 12 and exit through nozzle 26 and when pulled back in the direction of arrow 28 allows fluid to be aspirated, as explained above, by opening a needle valve (not shown) in the body of the airbrush 12 above connector fitting 22. Thumbwheel 30 is provided to permit the knob 24 to be set in the direction of arrow 28 to allow a chosen amount of fluid to exit from the nozzle 26 when the knob 24 is pushed down.

As stated above, the fluid supply is coupled to the selection means 20 by a hose bundle 18. The hose bundle 18 consists of a plurality of hoses 32, each hose 32 containing, for example, paint of a selected color. As is shown in FIGS. 2–4, the hoses 32 are coupled to a manifold 34, which may be made out of hard rubber or plastic, having a plurality of exit holes 36. The manifold 34 is coupled to a valve plate 38 and a housing 40 by bolt 42 embedded in the housing 40, washer 44 and nut 46 and is rotatable with respect to the valve plate 38. The valve plate 38 is fixedly coupled to housing 40, which may consist of solid rubber, by a plastic covering 48. The valve plate 38, which may be made of stainless steel, has an elongated aperture 50 therein which is aligned with a channel 52 extending through the housing 40. The channel 52 is shown formed in the solid rubber housing 40 and is coupled to connector fitting 22 by fitting 54. Alternately the housing 40, could be hollow with a spider mounted therein to support the bolt 42 and the channel 52 could consist of a tube coupled to the valve plate 38 and the fitting 54. The valve plate 38 used in conjunction with the solid housing 40 could be eliminated if an appropriately configured aperture, similar to aperture 50, is formed in the housing 40 to coact with the exit holes 36. While various materials have been described above from which to construct the various elements, any combination of materials can be used as long as a seal is maintained between movable elements to preclude fluid leakage.

In operation, the manifold 34 is rotated so that the exit holes 36 rotate past the aperture 50 and allow a selected paint color, such as red, orange, yellow, green, blue or purple, to enter the aperture 50 and the channel 52 and to be supplied to the airbrush 12 by the fitting 54 and the connector 22. The exit holes 36 are spaced sufficiently close together so that portions of adjacent exit holes 36 can be exposed to the elongated portions of the aperture 50 simultaneously, to blend colors from adjacent tubes at the aperture 50. If desired, the number of hoses 32 can be increased, as shown hereinafter, to provide black, white and a solvent to the airbrush 12. The fluid supply is placed generally above the level of the airbrush 12 so that the fluids are gravity fed to the airbrush 12. The fluids can, however, also be applied under a positive pressure if gravity feed is not convenient or desirable or to provide greater volume if a spray gun were to be used instead of the airbrush.

Referring now to FIGS. 5 and 6, the airbrush assembly 10' has a selection means 20' mounted to the airbrush 12' by a fitting 56 coupled to the side of the selection means 20'. The pneumatic hose 14' coupled to the airbrush 12' is integrated with the hoses 32' in hose bundle 18' so that a single hose carries both the fluid and the pressurized air. Since the fitting 56 is coupled to the side of the selection means 20', the bolt 58 can extend through the housing 40' and the bolt head 60 can secure the housing 40', the valve plate 38' and the manifold 34' together by means of washer 44' and nut 46'. The housing 40' is shown as being hollow with hose 62 replacing channel 52 shown in FIG. 2. In this particular embodiment, the manifold 34' remains stationary while the valve plate 38' is rotated to select the colors, or combinations of colors, to enter the aperture 50' and the hose 62 to be supplied to the airbrush 12'. Pins 64 are used to prevent the manifold 34' from rotating. Hose 62 is designed with sufficient flexibility to allow it to rotate with valve plate 38' and aperture 50'. The exit holes 36' of manifold 34' may be placed closer together than those shown in FIG. 3 so that the valve plate 38' need only rotate, for example, 210° to simplify the movement of the hose 62.

Figure 9:
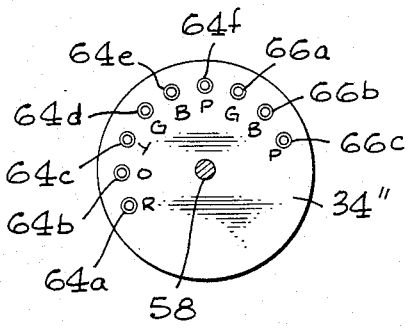
FIG. 9 is an end view of the selection means of FIG. 7 taken along line 9—9 of FIG. 7.
Figure 8:
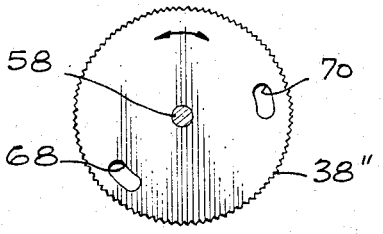
FIG. 8 is an end view of the selection means of FIG. 7 taken along line 8—8 of FIG. 7.
Figure 7:
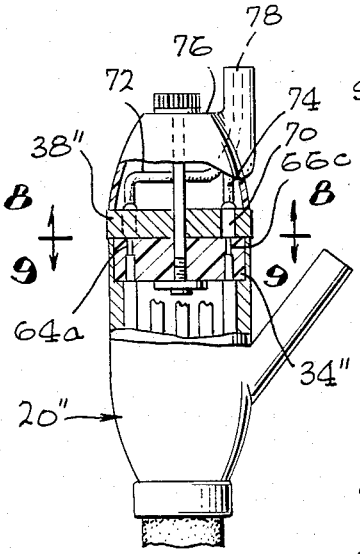
FIG. 7 is a side elevation, partially cross-sectional view of an alternate selection means useful in the embodiment of FIG. 5.

Referring now to FIGS. 7–9, a selection means 20'' is shown along with end views of manifold 34'' and valve plate 38''. The manifold 34'' has a plurality of exit holes **64*a–f* for the colors red, orange, yellow, green, blue and purple, which is to say, all the primary colors, arranged in spectral order, so that mechanically adjacent holes 64*a–f* respectively conduct spectrally adjacent colors. The manifold has a further plurality of exit holes 66*a–c* for the colors green, blue and purple. The valve plate 38'' has a primary pickup or aperture 68 and a complementary pickup or aperture 70. The primary pickup 68 and the complementary pickup 70 are coupled to hoses 72, 74, respectively, in housing 76 which join to form a single hose 78 leading to the airbrush 12'. In operation, the valve plate 38'' is rotated over the manifold 34'' and the primary pickup 68 sequentially allows the paint from the exit holes 64*a–f* to enter the hose 72 to be aspirated to the airbrush 12'**.

As before, colors from mechanically adjacent holes are blended by the elongated shape of the primary pickup 68. Since mechanically adjacent holes are assigned to spectrally adjacent colors, it follows logically that the device blends spectrally adjacent colors.

It further follows from the construction described that the blending is in rough proportion to the relative fractional areas of the mechanically adjacent holes that are opened by the primary pickup 68, for a given setting of the valve plate 38''.

As already noted, the holes **64*a–f* present the colors to the primary pickup 68** in their order of occurrence in the spectrum.

Therefore, continuous rotation of the single valve plate 38'', from a position in which pickup 68 opens only hole **64*a* to a position in which pickup 68 opens only hole 64*f*, produces a continuous, blended gradation of the colorant stream in hose 74; and this gradation starts with pure red colorant and progresses smoothly through the spectrum (that is, through orange, yellow, green and blue) to pure purple colorant. After the primary pickup 68 has rotated past exit hole 64*f*, the primary pickup 68 then again allows green paint from exit hole 66*a* to enter hose 72 while simultaneously complementary pickup 70 allows red paint, a complementary color, to enter hose 74 from exit hole 64*a* and mix with green paint in hose 78. Similarly, complementary blue/orange paints and complementary yellow/purple paints are allowed to mix from exit holes 66*b*/64*b* and 66*c*/64*c* in hose 78. As before, but now at the complementary pickup as well as the primary pickup, spectrally adjacent colors are blended by the elongated shape of the primary and complementary pickups 68, 70. The purpose of mixing complementary colorants, or complementary colorant blends, in this way is to provide extremely "intense" grays and charcoals, which can be graded continuously to the pure colorants (or to the pure adjacent-colorant blends that flow in either the complementary-pickup hose 74 or the primary-pickup hose 72) by throttling back the flow in either the complement hose 74 or the primary-pickup hose 72**.

If the primary and complementary flows are substantially the same, the result of the configuration just described is to produce a neutral gray at the discharge nozzle. If additional adjustable control is provided for the relative magnitudes of the primary and complementary flows, the result is to permit extremely subtle and delicate shadings between this neutral gray and any area of the spectrum. These capabilities result uniquely from the apparatus described, though the theory should be clear to persons skilled in the art of color mixing and control.

Figure 10:
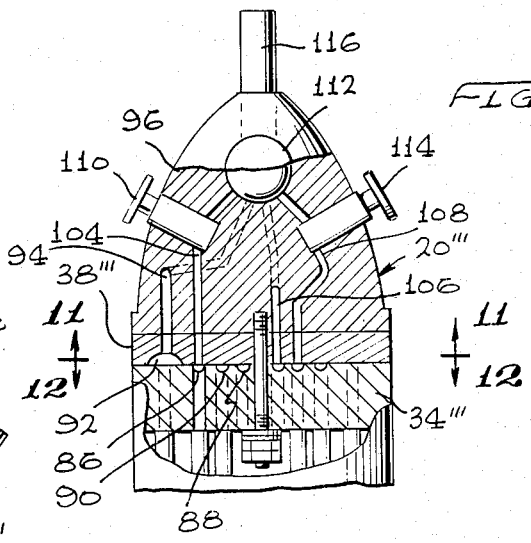
FIG. 10 illustrates in partial cross-section another selection means useful in the embodiment of FIG. 1.
Figure 11:
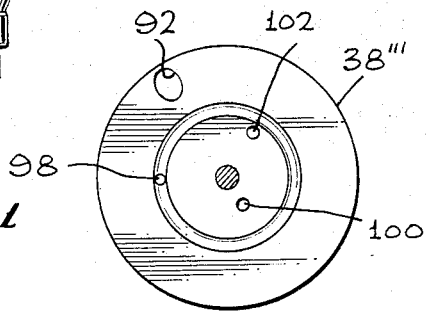
FIG. 11 is an end view of the selection means of FIG. 10 taken along line 11—11 of FIG. 10.
Figure 12:
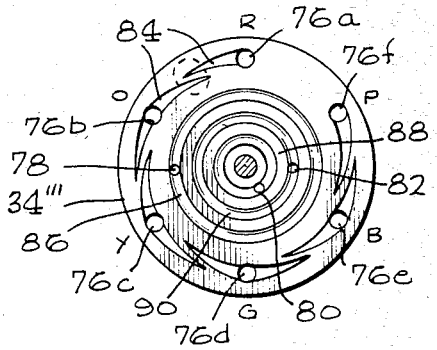
FIG. 12 is an end view of the selection means of the embodiment of FIG. 1 taken along line 12—12 of FIG. 10.

Referring now to FIGS. 10–12, a selection means 20''' is shown along with end views of manifold 34''' and valve plate 38'''. The manifold 34''' has a plurality of exit holes 76*a–f* for the colors red, orange, yellow, green, blue and purple and plurality of exit holes 78, 80 and 82 for black and white colors and a solvent, respectively. The exit holes 76*a–f* each have tapering concave regions 84 circumferentially extending from the edges thereof in both directions, except or exit holes 76*a* and 76*f* in which the tapering concave regions extend in one direction for exit hole 76*a* and the opposite direction for exit hole 76*f*. The exit holes 78, 80 and 82 each have circumferential grooves extending therefrom to form circular channels 86, 88, 90 in the face of the manifold 34'''. The valve plate 38''' has a radially elongated aperture 92 to allow the colors from the exit holes 76*a–f* to exit the manifold 34''' and enter channel 94 in housing 96. The radially elongated shape of the aperture 92 overlaps adjacent regions 84, as shown in phantom, and thus blends adjacent colors from regions 84 and exit holes 76*a–f* as manifold 34''' is rotated with respect to valve plate 38'''. The valve plate 38''' has additional apertures 98, 100 and 102 therein radially spaced so as to encounter channels 86, 88 and 90, respectively. Because of such channels 86, 88 and 90, black and white colors and solvent can always flow through exit holes 78, 80 and 82 into apertures 98, 100 and 102 and then into channels 104, 106 and 108. To control the flow and the mixing of the black and white colors and the solvent with the colors and with one another, valves 110, 112 and 114 are coupled to channels 104, 106 and 108 before such channels combine with channel 94 and one another into channel 116. Thus black, white or solvent can easily and selectively be mixed with the colors and with one another in channel 94. As may be inferred from the foregoing, the colorant selections and blends provided by my invention can be varied continuingly during operation of an airbrush, by manipulation of the adjustment knobs 38, 38' and 38'' of the respective embodiments. A skillful artist can train himself or herself to make such continuous adjustments at a rate that is coordinated with the motion of the airbrush outlet, relative to the surface to painted. Such an artist then can lay down a coating of colorant that is continuously graded along the surface in a virtually infinite variety of controllable and desirable ways.

Having thus described the invention, it is obvious that numerous modifications and departures may be made by those stated in the art. Thus, for example, the manifold could hold the fluid lines in a linear configuration and the aperture in the valve plate could linearly slide over the exit holes in the manifold to allow the colors to exit. The manifold in this embodiment would have linear channels running parallel to the exit holes and coupled to hoses for black, white and solvent, while the valve plate would have additional apertures coupled to such linear channels. In addition, the circular channels 86, 88 and 90 could just as readily be placed in the face of the valve plate 38'''. Thus the invention is to be construed as being limited only by the spirit and scope of the appended claims.

Industrial Applicability

The Airbrush assembly is useful in commercial, recreational and fine artistry and photography.

I claim:

1. A variable colorant blender for use with a painting apparatus for discharging colorant; said colorant blender comprising:

a plurality of discrete supply containers that contain respective different individual colorants;

means defining a plurality of supply paths connected to receive the individual colorants from the plurality of supply containers, respectively, the supply paths having respective supply-outlet openings that are disposed in a mechanical sequence;

colorant-pickup means that define a common pathway to the painting apparatus and that have an inlet end; and adjustable means for moving the inlet end relative to the openings, along the mechanical sequence, to selectively align the inlet end to receive such colorant either from one of the supply-outlet openings or from any two adjacent supply-outlet openings, for supply to such painting apparatus;

the inlet end and the supply-outlet openings being mutually configured to provide a generally gradual gradation of colorant flow from any of the supply-outlet openings to the inlet end when the adjustable inlet-moving means are adjusted to move the inlet end toward, past, and beyond that particular supply-outlet opening.

2. The color changer of claim 1, wherein:

the configuration of the inlet end in relation to the openings and in relation to the spacing of the mechanical sequence is such that, during operation when the adjustable inlet-moving means are manipulated to move the inlet end completely past said at least one of the openings:

the fraction of the total colorant flow in the inlet end that is received from that particular opening changes progressively from zero to one and then back to zero, the fraction of the total colorant flow in the inlet end that is received from one supply-outlet opening adjacent to that particular opening changes progressively from one to zero, and then remains at zero, the fraction of the total colorant flow in the inlet end that is received from another supply-outlet opening adjacent to that particular opening initially remains at zero, and then changes progressively from zero to one.

3. A color changer, for use with four or more discrete supply containers adapted to contain respective different individual colorants, and for use with a painting apparatus for discharging colorant; said color changer comprising:

means defining four or more supply paths adapted to be connected to receive such individual colorants from such four or more supply containers, respectively, the supply paths having respective supply-outlet openings that are arrayed in a fixed mechanical sequence having generally uniform spacing between adjacent supply-outlet openings, and the openings being of generally uniform length in the direction along the fixed sequence;

colorant-conducting means defining a common pickup structure and pathway, which are:

adapted to receive from any one of the supply-outlet openings, when aligned therewith, a corresponding one of such individual colorants from that supply-outlet opening, so configured, in relation to the supply-outlet openings, as to permit alignment of any two adjacent supply-outlet openings with the inlet end of the pathway simultaneously, so as to receive the corresponding two such individual colorants from those two openings simultaneously, and adapted to be connected to deliver either a received one or said received two of such individual colorants to such painting apparatus for discharge; and adjustable means for effecting relative motion between the supply-outlet openings and at least the inlet end of the pathway, to selectively align either a single one of the supply-outlet openings or any two adjacent supply-outlet openings with the inlet end of the pathway; and wherein— the relative-motion-effecting means move the pickup structure and pathway, relative to the supply-outlet openings, along said fixed mechanical sequence and completely past at least one of the supply-outlet openings;

the pickup structure and pathway define a receiving aperture that is:

long enough, in the direction along said fixed mechanical sequence, to span the spacing between any two adjacent openings and thereby to receive such colorants from any two adjacent openings simultaneously, but shorter than the sum of the said spacing and twice the length of each supply-outlet opening, to prevent the receiving aperture from fully uncovering more than one supply-outlet opening at a time; and when the relative-motion-effecting means are manipulated to move the pickup structure and pathway completely past said at least one of the openings:

the fraction of the total colorant flow in the pickup structure that is received from that particular opening changes progressively from zero to one and then back to zero, the fraction of the total colorant flow in the pickup structure that is received from one supply-outlet opening adjacent to that particular opening changes progressively from one to zero while the first-mentioned fraction changes from zero to one, and then remains at zero while the first-mentioned fraction changes back from one to zero, the fraction of the total colorant flow in the pickup structure that is received from another supply-outlet opening adjacent to that particular opening is zero while the first-mentioned fraction changes from zero to one, and then changes progressively from zero to one while the first-mentioned fraction changes from one back to zero;

whereby either a single one of such individual colorants or two such individual colorants in any two adjacent supply-outlet openings may be selected, by adjustment of the relative-motion-effecting means, for supply from such discrete containers to such painting apparatus; and whereby there is producible a continuously changing blend of such colorants, two at a time, in the order of the said mechanical sequence.

4. A painting-apparatus-and-color-changer combination for discharging different colorants selectably onto a surface to be colored, for use with a plurality of discrete supply containers adapted to contain respective individual ones of such different colorants; said combination comprising:

a painting apparatus for discharging selected ones of such different colorants in a continuous stream having controllable flow characteristics suitable for application of such colorants to such surface;

means defining a plurality of supply paths adapted to be connected to receive such different colorants from such plurality of supply containers, respectively, the said supply paths having respective supply-outlet openings that are disposed in an array;

colorant-pickup means defining a pickup structure that is:

movable with respect to the array of supply-outlet openings, adapted for alignment with any one of the respective supply-outlet openings, so as to receive a corresponding one of such different colorants from that supply-outlet opening, so configured, in relation to the supply-outlet openings, as to permit alignment of the pickup structure with a plurality of the supply-outlet openings simultaneously, so as to receive a corresponding plurality of such different colorants from that plurality of openings simultaneously, and adapted to be connected to deliver the received one or plurality of such different colorants to the painting apparatus for discharge; and adjustable means for effecting relative motion of the pickup structure with respect to the array of supply-outlet openings, to selectively align the pickup structure with one of the supply-outlet openings or with a plurality of the supply-outlet openings; and wherein— the pickup structure and the supply-outlet openings are mutually so configured as to provide a generally gradual gradation of colorant flow from any of the supply-outlet openings to the pickup structure when the relative-motion effecting means are adjusted to move the pickup structure by that particular supply-outlet opening;

the supply-outlet openings are arrayed in a fixed mechanical sequence having generally uniform spacing between adjacent supply-outlet openings, and the openings are of generally uniform length in the direction along the fixed sequence;

the relative-motion-effecting means move the pickup structure, relative to the supply-outlet openings, along said fixed mechanical sequence and completely past at least one of the supply-outlet openings;

the pickup structure defines a receiving aperture that is:

long enough, in the direction along said fixed mechanical sequence, to span the spacing between any two adjacent openings and thereby to receive such colorants from any two adjacent openings simultaneously, but shorter than the sum of the said spacing and twice the length of each supply-outlet opening, to prevent the receiving aperture from fully uncovering more than one supply-outlet opening at a time; and when the relative-motion-effecting means are manipulated to move the pickup structure completely past said at least one of the openings:

the fraction of the total colorant flow in the pickup structure that is received from that particular opening changes progressively from zero to one and then back to zero, the fraction of the total colorant flow in the pickup structure that is received from one supply-outlet opening adjacent to that particular opening changes progressively from one to zero while the first-mentioned fraction changes from zero to one, and then remains at zero while the first-mentioned fraction changes back from one to zero, the fraction of the total colorant flow in the pickup structure that is received from another supply-outlet opening adjacent to that particular opening is zero while the first-mentioned fraction changes from zero to one, and then changes progressively from zero to one while the first-mentioned fraction changes from one back to zero;

whereby a single one of such different colorants or a plurality of such different colorants may be selected, by adjustment of the relative-motion-effecting means, for supply from such discrete containers to the painting apparatus; and may be discharged by the painting apparatus;

whereby the pickup structure may receive such colorant from any two adjacent openings simultaneously, in generally gradually changing proportions as the relative-motion effecting means are adjusted to move the pickup structure by or between those two particular adjacent openings; and whereby there is producible a continuously changing blend of such colorants, two at a time, in the order of the said mchanical sequence.

5. A painting-apparatus-and-colorant-supply-and-color-changer combination for discharging different colorants selectably onto a surface to be colored; said combination comprising:

a painting apparatus for discharging selected ones of such different colorants in a continuous stream having controllable flow characteristics suitable for application of such colorants to such surface;

means defining a plurality of discrete supply containers adapted to contain respective individual ones of such different colorants;

means defining a plurality of supply paths adapted to be connected to receive such different colorants from the plurality of supply containers, respectively, the said supply paths having respective supply-outlet openings that are disposed in an array;

means for supporting and pressurizing the supply containers, to urge such colorants under pressure from the supply containers to the supply paths;

colorant-pickup means defining a pickup structure that is:

movable with respect to the array of supply-outlet openings, adapted for alignment with any one of the respective supply-outlet openings, so as to receive a corresponding one of such different colorants from that supply-outlet opening, so configured, in relation to the supply-outlet openings, as to permit alignment of the pickup structure with a plurality of the supply-outlet openings simultaneously, so as to receive a corresponding plurality of such different colorants from that plurality of openings simultaneously, and adapted to be connected to deliver the received one or plurality of such different colorants to the painting apparatus for discharge; and adjustable means for effecting relative motion of the pickup structure with respect to the array of supply-outlet openings, to selectively align the pickup structure with one of the supply-outlet openings or with a plurality of the supply-outlet openings; and wherein:

the pickup structure and the supply-outlet openings are mutually so configured as to provide a generally gradual gradation of colorant flow from any of the supply-outlet openings to the pickup structure when the relative-motion effecting means are adjusted to move the pickup structure by that particular supply-outlet opening;

the supply-outlet openings are arrayed in a fixed mechanical sequence having generally uniform spacing between adjacent supply-outlet openings, and the openings are of generally uniform length in the direction along the fixed sequence;

the relative-motion-effecting means move the pickup structure, relative to the supply-outlet openings, along said fixed mechanical sequence and completely past at least one of the supply-outlet openings;

the pickup structure defines a receiving aperture that is:

long enough, in the direction along said fixed mechanical sequence, to span the spacing between any two adjacent openings and thereby to receive such colorants from any two adjacent openings simultaneously, but shorter than the sum of the said spacing and twice the length of each supply-outlet opening, to prevent the receiving aperture from fully uncovering more than one supply-outlet opening at a time; and when the relative-motion-effecting means are manipulated to move the pickup structure completely past said at least one of the openings:

the fraction of the total colorant flow in the pickup structure that is received from that particular opening changes progressively from zero to one and then back to zero, the fraction of the total colorant flow in the pickup structure that is received from one supply-outlet opening adjacent to that particular opening changes progressively from one to zero while the first-mentioned fraction changes from zero to one, and then remains at zero while the first-mentioned fraction changes back from one to zero, the fraction of the total colorant flow in the pickup structure that is received from another supply-outlet opening adjacent to that particular opening is zero while the first-mentioned fraction changes from zero to one, and then changes progressively from zero to one while the first-mentioned fraction changes from one back to zero;

whereby the pickup structure may receive such colorant from any two adjacent openings simultaneously, in generally gradually changing proportions as the relative-motion effecting means are adjusted to move the pickup structure by or between those two particular adjacent openings;

whereby a single one of such different colorants or a plurality of such different colorants may be selected, by adjustment of the relative-motion-effecting means, for supply from such discrete containers to the painting apparatus; and may be discharged by the painting apparatus; and whereby there is producible a continuously changing blend of such colorants, two at a time, in the order of the said mechanical sequence.

6. A color changer, for use with four or more discrete supply containers adapted to contain respective different individual colorants, and for use with a painting apparatus for discharging colorant; said color changer comprising:

means defining four or more supply paths adapted to be connected to receive such individual colorants from such four or more supply containers, respectively, the said supply paths having respective supply-outlet openings that are arrayed in a fixed mechanical sequence having generally uniform spacing between adjacent supply-outlet openings, and the openings being of generally uniform length in the direction along the fixed sequence;

colorant-pickup means defining a pickup structure that is:

movable with respect to the sequence of supply-outlet openings, adapted for alignment wih any one of the respective supply-outlet openings, so as to receive a corresponding one of such individual colorants from that supply-outlet opening, so configured, in relation to the array of supply-outlet openings, as to permit alignment of the pickup structure with any two adjacent supply-outlet openings simultaneously, so as to receive a corresponding two of such individual colorants from those two adjacent openings simultaneously, and adapted to be connected to deliver either said received one or said received two of such individual colorants to such painting apparatus for discharge; and adjustable means for effecting relative motion of the pickup structure with respect to the array of supply-outlet openings, to selectively align the pickup structure either with one of the supply-outlet openings or with any two adjacent supply-outlet openings; and wherein the relative-motion-effecting means move the pickup structure, relative to the supply-outlet openings, along said fixed mechanical sequence and completely past at least one of the supply-outlet openings;

the pickup structure defines a receiving aperture that is:

long enough, in the direction along said fixed mechanical sequence, to span the spacing between any two adjacent openings and thereby to receive such colorants from any two adjacent openings simultaneously, but shorter than the sum of the said spacing and twice the length of each supply-outlet opening, to prevent the receiving aperture from fully uncovering more than one supply-outlet opening at a time; and when the relative-motion-effecting means are manipulated to move the pickup structure completely past said at least one of the openings:

the fraction of the total colorant flow in the pickup structure that is received from that particular opening changes progressively from zero to one and then back to zero, the fraction of the total colorant flow in the pickup structure that is received from one supply-outlet opening adjacent to that particular opening changes progressively from one to zero while the first-mentioned fraction changes from zero to one, and then remains at zero while the first-mentioned fraction changes back from one to zero, the fraction of the total colorant flow in the pickup structure that is received from another supply-outlet opening adjacent to that particular opening is zero while the first-mentioned fraction changes from zero to one, and then changes progressively from zero to one while the first-mentioned fraction changes from one back to zero;

whereby either a single one of such individual colorants or two of such individual colorants received from said two adjacent openings may be selected, by adjustment of the relative-motion-effecting means, for supply from such discrete containers to such painting apparatus; and whereby there is producible a continuously changing blend of such colorants, two at a time, in the order of the said mechanical sequence.

7. A color changer for use with a plurality of discrete supply containers adapted to contain respective different individual colorants, and for use with a painting apparatus for discharging colorant; said color changer comprising:

means defining a plurality of supply paths adapted to be connected to receive such individual colorants from such plurality of supply containers, respectively, the said supply paths having respective supply-outlet openings that are arrayed in a fixed mechanical sequence having generally uniform spacing between adjacent supply-outlet openings, and the openings being of generally uniform length in the direction along the fixed sequence;

colorant-pickup means defining a pickup structure that is:

movable with respect to the sequence of supply-outlet openings, adapted for alignment with any one of the respective supply-outlet openings, so as to receive a corresponding one of such individual colorants from that supply-outlet opening, so configured, in relation to the array of supply-outlet openings, as to permit alignment of the pickup structure with any two adjacent supply-outlet openings simultaneously, so as to receive a corresponding plurality of such individual colorants from that plurality of openings simultaneously, and adapted to be connected to deliver either said received one or said received plurality of such individual colorants to such painting apparatus for discharge; and adjustable means for effecting relative motion of the pickup structure with respect to the array of supply-outlet openings, to selectively align the pickup structure either with one of the supply-outlet openings or with any two adjacent supply-outlet openings; and wherein the relative-motion-effecting means move the pickup structure, relative to the supply-outlet openings, along said fixed mechanical sequence and completely past at least one of the supply-outlet openings;

the pickup structure defines a receiving aperture that is:

long enough, in the direction along said fixed mechanical sequence, to span the spacing between any two adjacent openings and thereby to receive such colorants from any two adjacent openings simultaneously, but shorter than the sum of the said spacing and twice the length of each supply-outlet opening, to prevent the receiving aperture from fully uncovering more than one supply-outlet opening at a time;

the pickup structure and the supply-outlet openings being mutually so configured as to provide a generally gradual gradation of colorant flow from any of the supply-outlet openings to the pickup structure when the relative-motion effecting means are adjusted to move the pickup structure by that particular supply-outlet opening; and when the relative-motion-effecting means are manipulated to move the pickup structure completely past said at least one of the openings:

the fraction of the total colorant flow in the pickup structure that is received from that particular opening changes progressively from zero to one and then back to zero, the fraction of the total colorant flow in the pickup structure that is received from one supply-outlet opening adjacent to that particular opening changes progressively from one to zero while the first-mentioned fraction changes from zero to one, and then remains at zero while the first-mentioned fraction changes back from one to zero, the fraction of the total colorant flow in the pickup structure that is received from another supply-outlet opening adjacent to that particular opening is zero while the first-mentioned fraction changes from zero to one, and then changes progressively from zero to one while the first-mentioned fraction changes from one back to zero;

whereby either a single one of such individual colorants or a plurality of such individual colorants may be selected, by adjustment of the relative-motion-effecting means, for supply from such discrete containers to such painting apparatus;

whereby the pickup structure may receive such colorant from any two adjacent openings simultaneously, in generally gradually changing proportions as the relative-motion effecting means are adjusted to move the pickup structure by or between those two particular adjacent openings; and whereby there is producible a continuously changing blend of such colorants, two at a time, in the order of the said mechanical sequence.

* * * * *